US006548238B2

(12) United States Patent
Weber et al.

(10) Patent No.: US 6,548,238 B2
(45) Date of Patent: Apr. 15, 2003

(54) COLOR PHOTOGRAPHIC RECORDING MATERIAL

(75) Inventors: Beate Weber, Leichlingen (DE); Bernd Spachmann, Kürten (DE); Heinz Wiesen, Euskirchen (DE)

(73) Assignee: AGFA-Gevaert (BE)

( * ) Notice: Subject to any disclaimer, the term of this patent is extended or adjusted under 35 U.S.C. 154(b) by 0 days.

(21) Appl. No.: 09/910,367

(22) Filed: Jul. 20, 2001

(65) Prior Publication Data

US 2002/0064734 A1 May 30, 2002

(30) Foreign Application Priority Data

Jul. 24, 2000 (DE) ..... 100 35 861
Aug. 8, 2000 (DE) ..... 100 38 486

(51) Int. Cl.[7] ..... G03C 1/08; G03C 7/26; G03C 7/32

(52) U.S. Cl. ..... 430/551; 430/502; 430/627; 430/628; 430/630; 430/629; 430/557; 430/543

(58) Field of Search ..... 430/502, 551, 430/627, 628, 630, 557, 629, 543

(56) References Cited

U.S. PATENT DOCUMENTS 2,495,918 A * 1/1950 Bolton ..... 430/630
4,045,226 A * 8/1977 Hara et al. ..... 430/627
4,284,718 A * 8/1981 Bergthaller et al. ..... 430/629
4,431,730 A * 2/1984 Urabe et al. ..... 430/627

* cited by examiner

*Primary Examiner*—Geraldine Letscher
(74) *Attorney, Agent, or Firm*—Connolly Bove Lodge & Hutz LLP

(57) ABSTRACT

The stability of the dyes which are obtained after processing a color photographic material is improved by the addition of a polyvinylcaprolactam.

19 Claims, No Drawings

COLOR PHOTOGRAPHIC RECORDING MATERIAL

The present invention relates to a colour photographic material which comprises at least one spectrally sensitised AgX emulsion layer as well as at least one additive for improving the stability of dyes.

Colour photographic materials usually contain at least one yellow coupler, at least one magenta coupler and at least one cyan coupler, from which the corresponding dyes are formed by exposure and development. These dyes, particularly dyes which are continuously exposed to light, should exhibit high colour stability, and particular value is placed on the colour stability of all three colours being as good and as identical as possible, so that slight fading does not give rise to colour distortion. In particular, yellow dyes which are produced from couplers containing an open chain ketomethylene grouping have to be stabilised both from light and from fading in the dark. It is known from EP 317 983 that polyacrylamides can be added to yellow couplers; this does not always result in sufficient stability in the dark, however.

There is thus a continuing need for dyes which exhibit improved stability to light.

The underlying object of the present invention is therefore to produce colour photographic materials which are distinguished by their high stability to light.

This object is achieved by the addition of defined polyvinylcaprolactams.

The present invention relates to a colour photographic material which contains at least one light-sensitive silver halide emulsion layer, and which, in at least one layer which contains a colour coupler, contains at least one homo- or copolymer which comprises a monomer unit of formula (II)

(II)

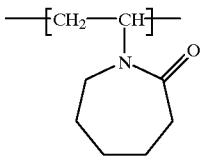

wherein the monomer unit (II) amounts to at least 10% by weight in copolymers.

The coupler preferably corresponds to formula (I)

(I)

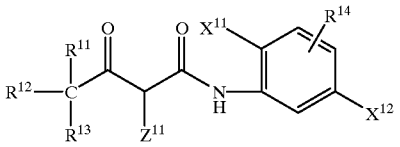

where $R^{11}$ and $R^{12}$, independently of each other in each case, represent alkyl, or $R^{11}$ and $R^{12}$ can jointly form a ring system, $R^{13}$ represents H or has the meaning of $R^{11}$ or $R^{12}$, $R^{14}$ represents H, alkyl or halogen, $X^{11}$ represents halogen or alkoxy, $X^{12}$ represents acyl, acylamino, halogen, sulphonamido or sulphamoyl, $Z^{11}$ represents a group of formula

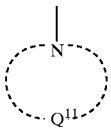

and $Q^{11}$ represents an organic group for the completion of a 5- or 6-membered ring, and preferably denotes imidazole, 1,3,4-triazole, oxazoledione or hydantoin derivatives.

The monomer unit in copolymers preferably amounts to at least 40% by weight.

Suitable comonomers include esters of acrylic acid, esters of methacrylic acid, vinyl esters, vinyl ethers, olefines and methacrylamides. Methacrylamides are preferably used in amounts up to 50% by weight only.

The preferred comonomers are esters of acrylic acid, e.g. ethyl, butyl and hydroxyethyl acrylates.

The polymers can be produced by customary methods of radical, homo- or copolymerisation. The average molecular weight (weight average) of the polymers ranges between 2000 and 1,000,000, particularly between 2000 and 400,000, most preferably between 10,000 and 150,000.

In addition, at least one compound of formula (III) can be used (III)

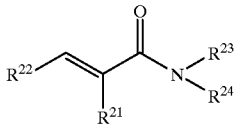

where $R^{21}$ represents H or alkyl, $R^{22}$ represents H, alkyl or aryl, and $R^{23}$ and $R^{24}$, independently of each other in each case, represent an aryl, a secondary alkyl or a tertiary alkyl.

The term "alkyl" in the sense of the present Application is to be understood to mean linear, branched, or cyclic hydrocarbon radicals. The latter can themselves be substituted, for example with a halogen, hydroxy, alkoxy, aryl, arloxy, acyl, acyloxy, acylamino, sulpho, carboxy or cyano group. The $R^{11}$ and $R^{12}$ radicals are preferably alkyl radicals containing 1 to 4 C atoms.

The term "aryl" in the sense of the present Application is to be understood to mean aromatic hydrocarbon radicals, such as benzyl or naphthyl for example, which can themselves be substituted, for example with a halogen, hydroxy, alkyl, alkoxy, aryloxy, acyl, acyloxy, acylamino, sulpho, carboxy and cyano group.

Acyl radicals in the sense of the present Application are to be understood to mean radicals of saturated or unsaturated aliphatic or aromatic carboxylic, carbonic, carbamic, sulphonic, amidosulphonic, phosphoric, phosphonic, sulphinic or phosphorous acids.

The term "halogen" in the sense of the present Application is to be understood to mean fluorine, chlorine, bromine and iodine, particularly chlorine and bromine.

In one preferred embodiment, $R^{14}$ represents H, $X^{11}$ represents chlorine or alkoxy, $X^{12}$ represetns alkoxycarbonyl or alkylcarbonylamino, $R^{21}$ represents hydrogen or methyl, $R^{22}$ represents hydrogen, methyl, phenyl or 4-alkoxyphenyl. Particularly preferred embodiments of formula (I) correspond to formulae (Ib) or (Ic)

(Ib)

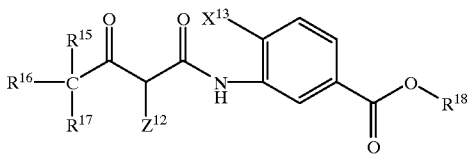

(Ic)

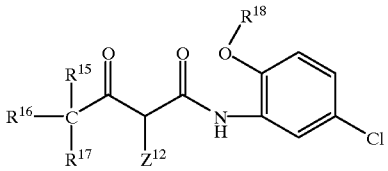

where $R^{15}$ and $R^{16}$ can represent methyl or $R^{15}$ and $R^{16}$ can jointly form a 3- to 6-membered, carbocylic ring, $R^{17}$ represents H or methyl, $Z^{12}$ has the same meaning as $Z^{11}$, $X^{13}$ represents chlorine or alkoxy, and $R^{18}$ represents alkyl.

Particularly preferred compounds of formula (III) are those of the following formula (IIIa)

(IIIa)

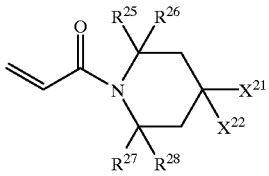

where $R^{25}$ and $R^{27}$, independently of each other, represent H or alkyl, $R^{26}$ and $R^{28}$, independently of each other, represent alkyl, $X^{21}$ represents alkoxy, acyl, acylamino, alkylamino or acyloxy, and $X^{22}$ represents H or has the same meaning as $X^{21}$ with the proviso that $X^{21}$ and $X^{22}$ can jointly form a 5- to 6-membered ring, and wherein (IIIa) contains no hydroxyphenol substituents.

$R^{15}$, $R^{16}$, $R^{17}$, $R^{25}$, $R^{26}$, $R^{27}$ and $R^{28}$ preferably denote $CH_3$.

Typical examples of compounds of formula (I) according to the invention are listed below:

I-1

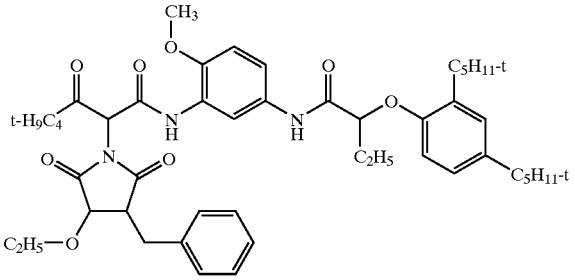

I-2

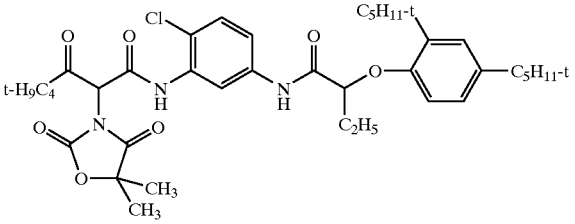

I-3

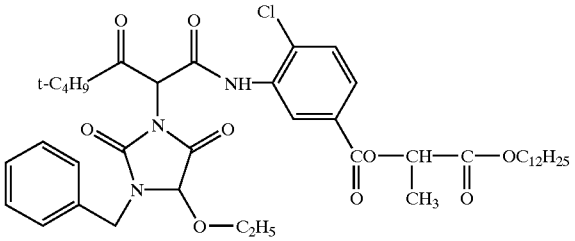

I-4

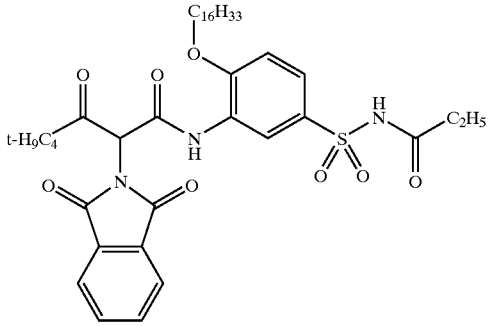

I-5

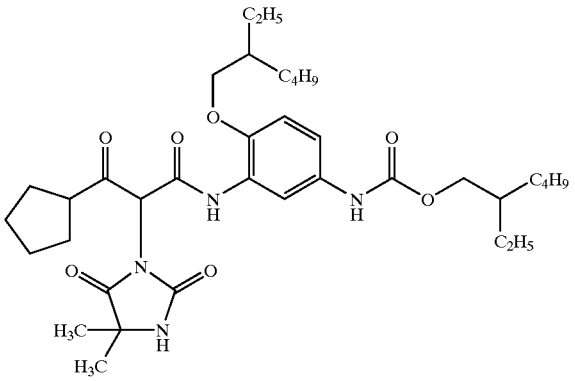

-continued
I-6
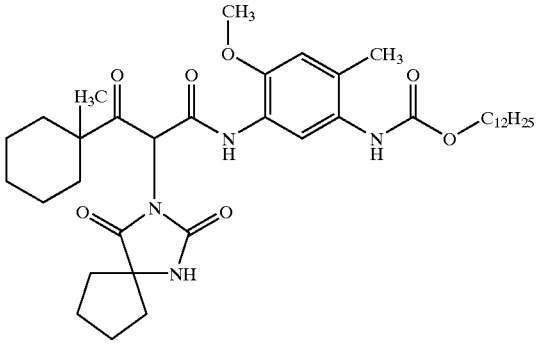
I-7
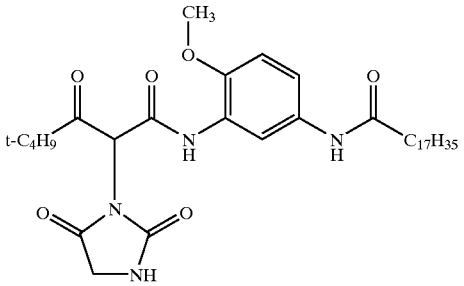
I-8
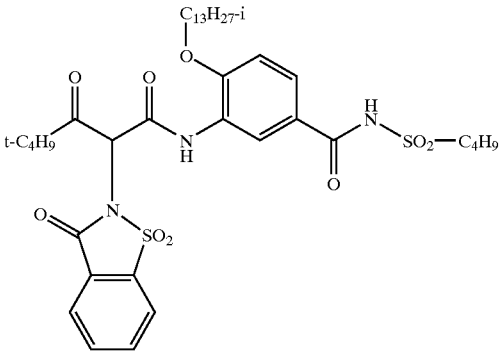
I-9
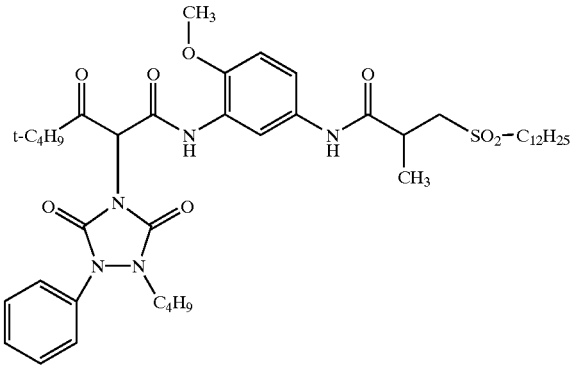
-continued
I-10
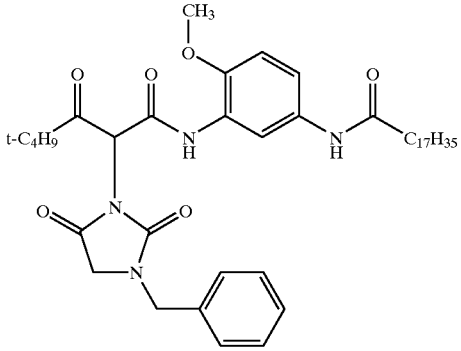
I-11
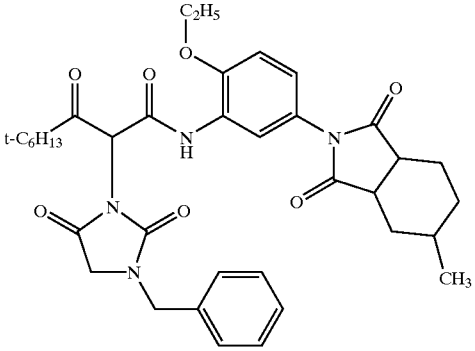
I-12
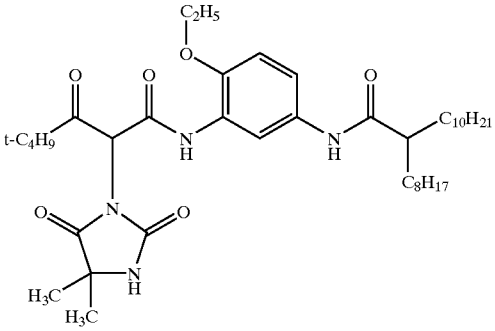
I-13
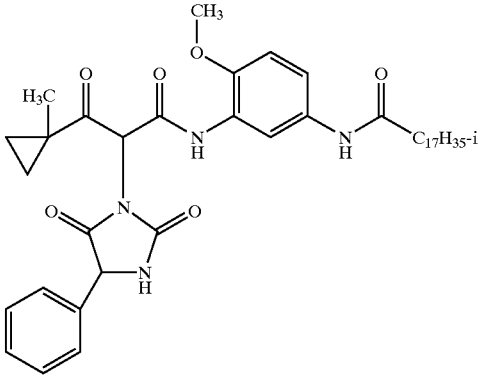

-continued
I-14
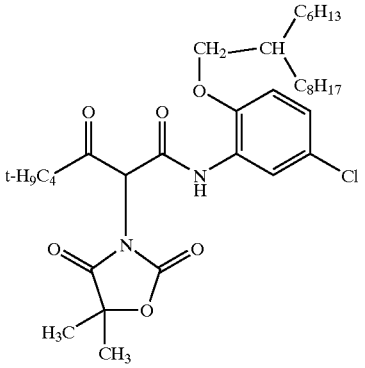
I-15
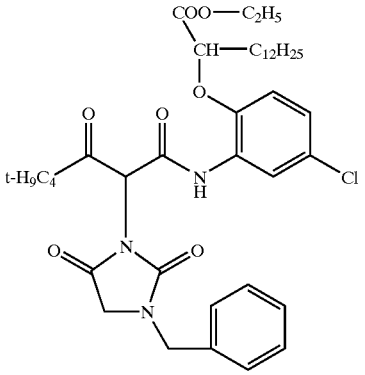
I-16
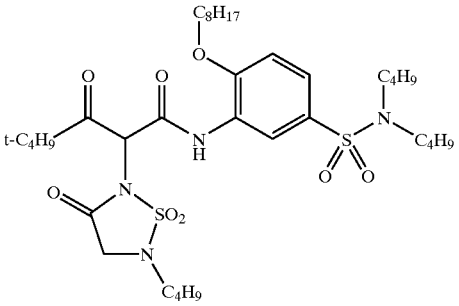
I-17
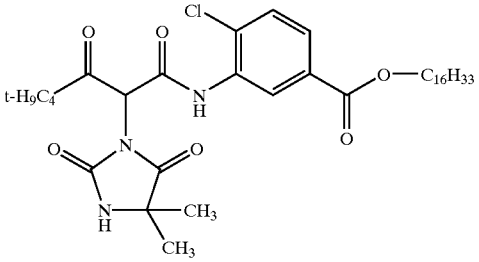
I-18
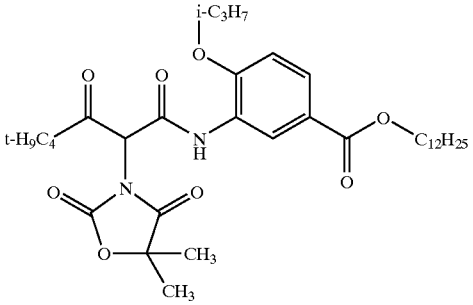
-continued
I-19
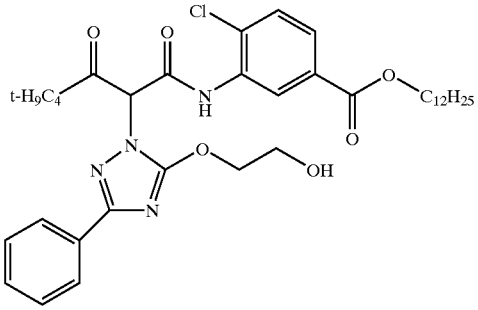
I-20
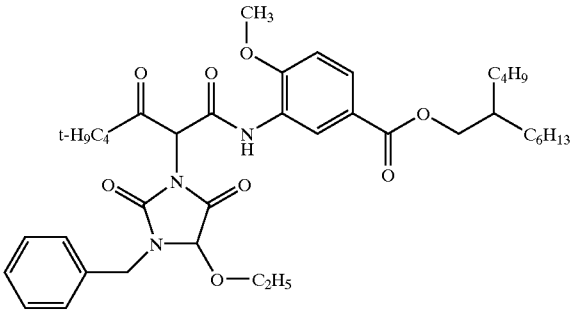
I-21
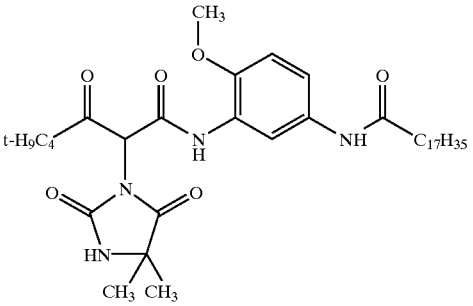
I-22
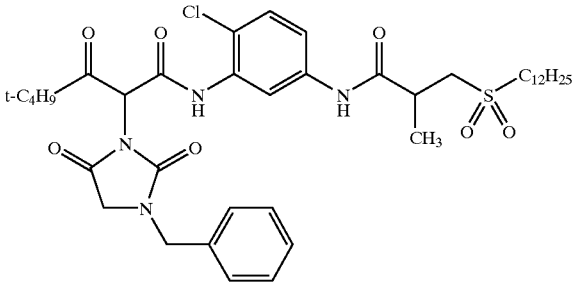
I-23
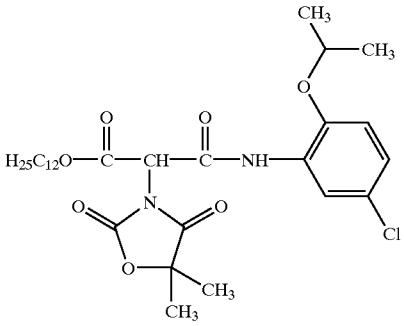

-continued

I-24

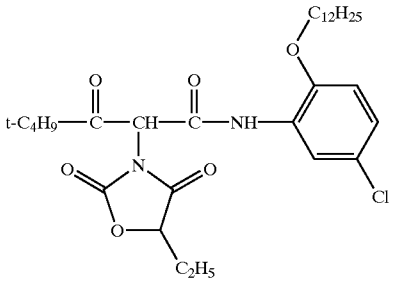

I-25

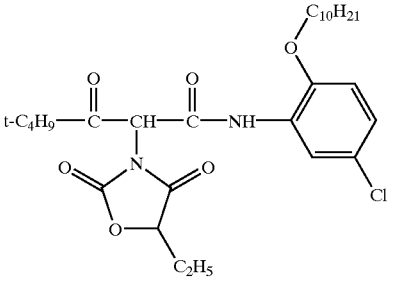

I-26

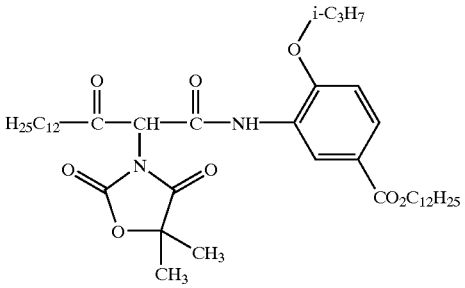

Examples of compounds II according to the invention include:

II-1 polyvinylcaprolactam

II-2 a copolymer of vinylcaprolactam and ethyl acrylate (50% by weight of each)

II-3 a copolymer of 50% by weight vinylcaprolactam, 40% by weight t-butylacrylamide and 10% by weight hydroxyethyl acrylate II-4 a copolymer of 75% by weight vinylcaprolactam and 25% by weight t-butylacrylamide II-5 a copolymer of 95% by weight vinylcaprolactam and 5% by weight

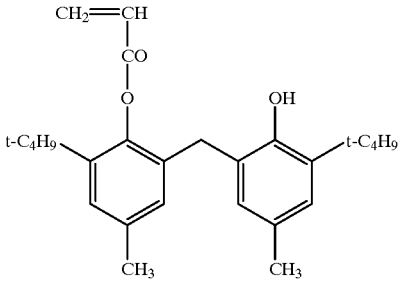

Typical examples of formula (III) according to the invention are listed below:

III-1

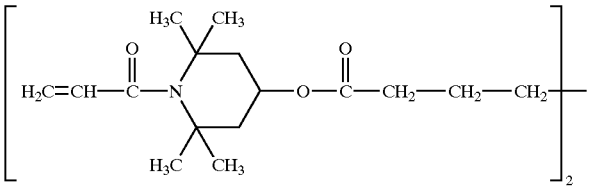

III-2

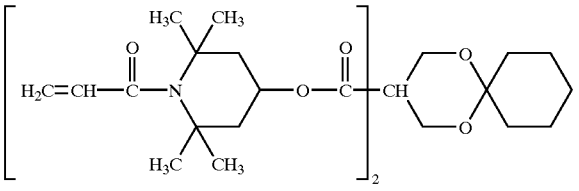

III-3

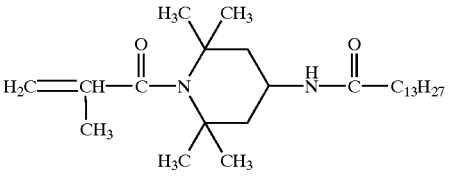

III-4

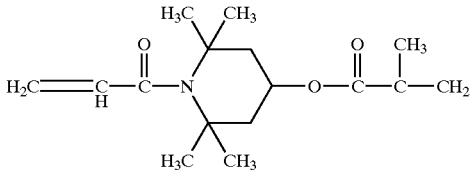

III-5

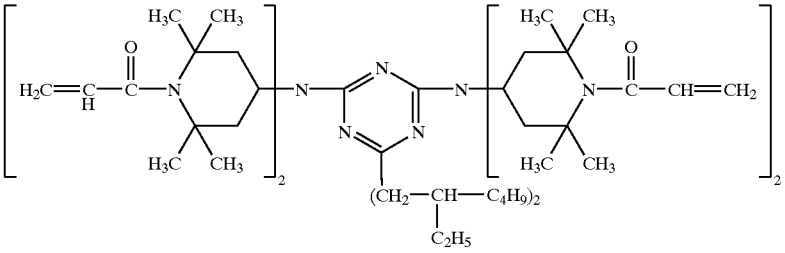

-continued
III-6
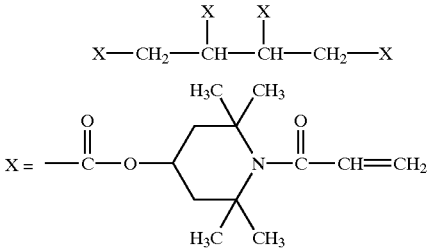
III-7
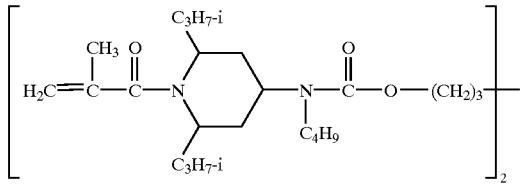
III-8
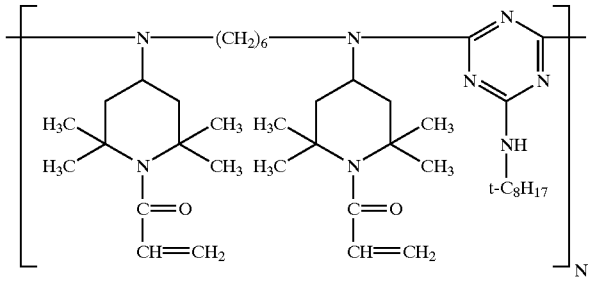
$M_w$ = 3500
III-9
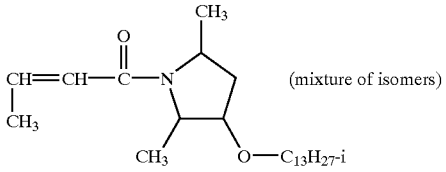
(mixture of isomers)
III-10
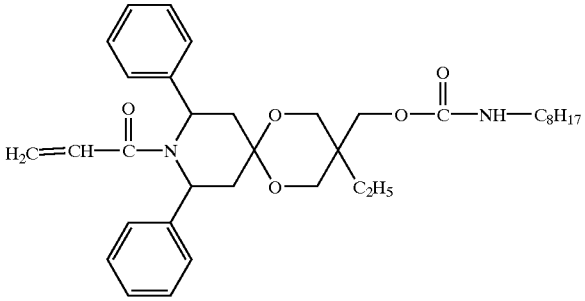
III-11
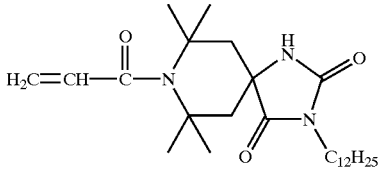
III-12
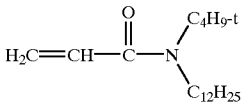
III-13
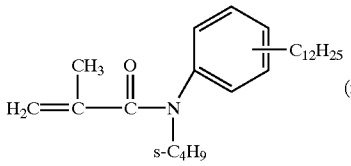
(mixture of isomers)
III-14
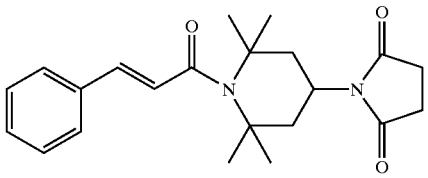
III-15
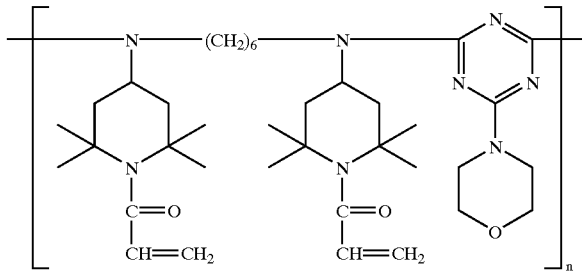
$M_w$ = 3000

-continued

III-16

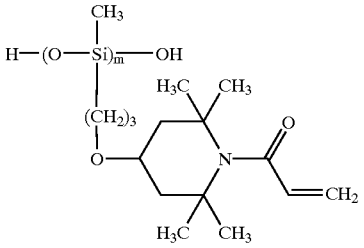

$M_w = 4300$

III-17

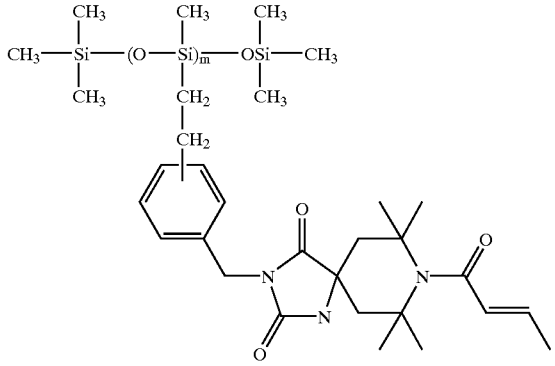

$M_w = 5000$

According to the invention, the photographic material can contain compounds of formula (I) in an amount from 100 to 3000, preferably 200 to 1500, particularly 300 to 1000 mg/m$^2$.

The compounds of formula (II) can be contained in the photographic material in a ratio by weight from 1:20 to 10:1, preferably in a ratio by weight from 1:10 to 2:1, with respect to the compound of formula (I).

The compounds of formula (III) can be contained in a ratio by weight from 1:20 to 2:1 with respect to the compound of formula (I). They are preferably contained in a ratio by weight from 1:10 to 1:1.

In addition, high-boiling organic solvents and other polymers can be used, e.g. those which are known from DE-OS 25 35 497 and U.S. Pat. No. 4,857,449.

In one particularly preferred embodiment, phenolic image stabilisers of formula (IV) are also used in addition, (IV)

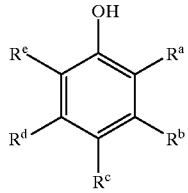

where $R^a$, $R^b$, $R^d$, $R^e$ represent H, alkyl, aryl, aralkyl, acylamino, acyl or halogen, and $R^c$ represents alkyl, aryl, aralkyl, acyl or acylamino.

Some typical examples are listed below:

IV-1

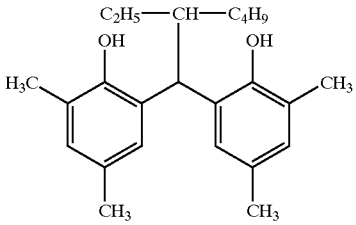

IV-2

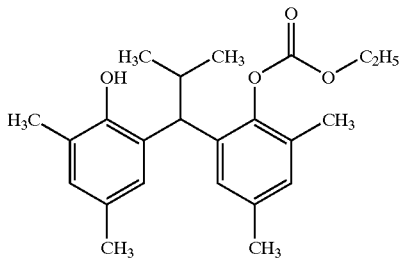

IV-3

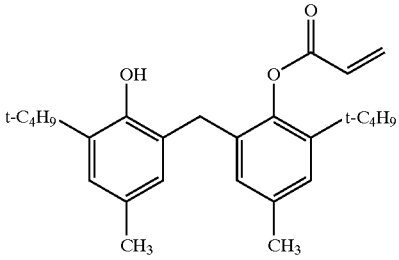

IV-4

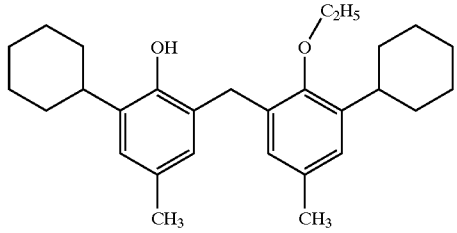

-continued

IV-5

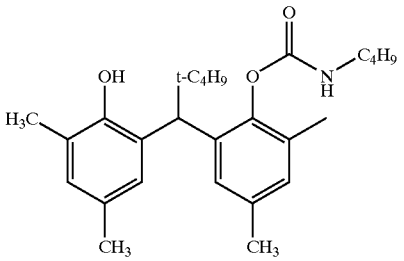

IV-6

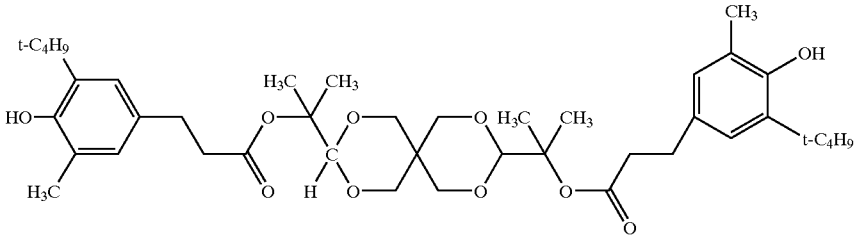

IV-7

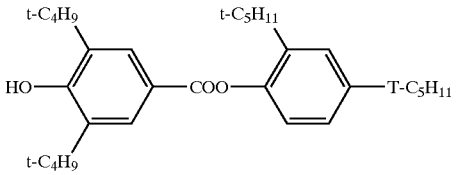

IV-8

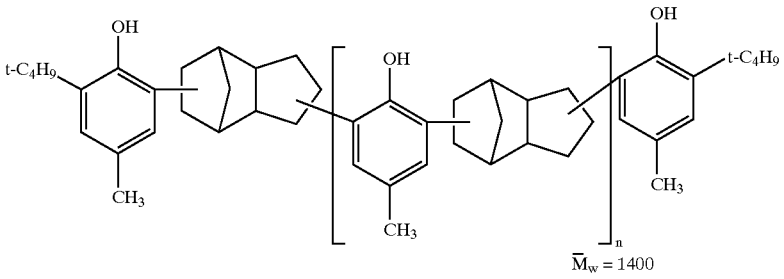

IV-9

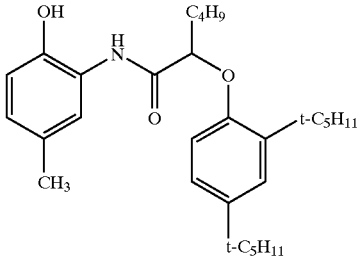

Examples of colour photographic materials include colour negative films, colour reversal films, colour positive films, colour photographic paper, colour reversal photographic paper, and colour-sensitive materials for the colour diffusion transfer process or the silver halide bleaching process. Reviews thereof are given in Research Disclosure 37038 (1995) and in Research Disclosure 38957 (1996).

Photographic materials consist of a support on which at least one light-sensitive silver halide emulsion layer is deposited. Thin films and foils are particularly suitable as supports. A review of support materials and of the auxiliary layers which are deposited on the front and back thereof is given in Research Disclosure 37254, Part 1 (1995), page 285 and in Research Disclosure 38957, Part XV (1996), page 627.

Colour photographic materials usually contain at least one red-sensitive, at least one green-sensitive and at least one blue-sensitive silver halide emulsion layer, and optionally contain intermediate layers and protective layers also.

Depending on the type of photographic material, these layers may be arranged differently. This will be illustrated for the most important products:

Colour photographic films such as colour negative films and colour reversal films comprise, in the following sequence on their support: 2 or 3 red-sensitive, cyan-coupling silver halide emulsion layers, 2 or 3 green-sensitive, magenta coupling silver halide emulsion layers, and 2 or 3 blue-sensitive, yellow-coupling silver halide emulsion layers. The layers of identical spectral sensitivity differ as regards their photographic speed, wherein the less sensitive partial layers are generally disposed nearer the support than are the more highly sensitive partial layers.

A yellow filter layer is usually provided between the green-sensitive and blue-sensitive layers, to prevent blue light from reaching the layers underneath.

The options for different layer arrangements and their effects on photographic properties are described in J. Inf. Rec. Mats., 1994, Vol. 22, pages 183–193, and in Research Disclosure 38957, Part XI (1996), page 624.

Colour photographic paper, which as a rule is less sensitive to light than is colour photographic film, usually comprises the following layers on the support, in the following sequence: a blue-sensitive, yellow-coupling silver halide emulsion layer, a green-sensitive, magenta coupling silver halide emulsion layer, and a red-sensitive, cyan-coupling silver halide emulsion layer. The yellow filter layer can be omitted.

Departures from the number and arrangement of the light-sensitive layers may be effected in order to achieve defined results. For example, all the high-sensitivity layers may be combined to form a layer stack and all the low-sensitivity layers may be combined to form another layer stack in a photographic film, in order to increase the sensitivity (DE 25 30 645).

The essential constituents of the photographic emulsion layer are binders, silver halide grains and colour couplers.

Information on suitable binders is given in Research Disclosure 37254, Part 2 (1995), page 286, and in Research Disclosure 38957, Part IIa (1996), page 598.

Information on suitable silver halide emulsions, their production, ripening, stabilisation and spectral sensitisation, including suitable spectral sensitisers, is given in Research Disclosure 37254, Part 3 (1995), page 286, in Research Disclosure 37038, Part XV (1995), page 89, and in Research Disclosure 38957, Part V.A (1996), page 603. Photographic materials which exhibit camera-sensitivity usually contain silver bromide-iodide emulsions, which may also optionally contain small proportions of silver chloride. Photographic copier materials contain either silver chloride-bromide emulsions comprising up to 80 mole % AgBr, or silver chloride-bromide emulsions comprising more than 95 mole % AgCl.

Information on colour couplers is to be found in Research Disclosure 37254, Part 4 (1995), page 288, in Research Disclosure 37038, Part II (1995), page 80, and in Research Disclosure 38957, Part X.B (1996), page 616. The maximum absorption of the dyes formed from the couplers and from the colour developer oxidation product preferably falls within the following ranges: yellow couplers 430 to 460 nm, magenta couplers 540 to 560 nm, cyan couplers 630 to 700 nm.

In order to improve sensitivity, granularity, sharpness and colour separation, compounds are frequently used in colour photographic films which on reaction with the developer oxidation product release compounds which are photographically active, e.g. DIR couplers, which release a development inhibitor.

Information on compounds such as these, particularly couplers, is to be found in Research Disclosure 37254, Part 5 (1995), page 290, in Research Disclosure 37038, Part XIV (1995), page 86, and in Research Disclosure 38957, Part X.C (1996), page 618.

The colour couplers, which are mostly hydrophobic, and other hydrophobic constituents of the layers also, are usually dissolved or dispersed in high-boiling organic solvents. These solutions or dispersions are then emulsified in an aqueous binder solution (usually a gelatine solution), and after the layers have been dried are present as fine droplets (0.05 to 0.8 $\mu$m diameter) in the layers.

Suitable high-boiling organic solvents, methods of introduction into the layers of a photographic material, and other methods of introducing chemical compounds into photographic layers, are described in Research Disclosure 37254, Part 6 (1995), page 292.

The light-insensitive intermediate layers which are generally disposed between layers of different spectral sensitivity may contain media which prevent the unwanted diffusion of developer oxidation products from one light-sensitive layer into another light-sensitive layer which has a different spectral sensitivity.

Suitable compounds (white couplers, scavengers or DOP scavengers) are described in Research Disclosure 37254, Part 7 (1995), page 292, in Research Disclosure 37038, Part III (1995), page 84, and in Research Disclosure 38957, Part X.D (1996), page 621 et seq.

The photographic material may additionally contain compounds which absorb UV light, brighteners, spacers, filter dyes, formalin scavengers, light stabilisers, anti-oxidants, $D_{Min}$ dyes, plasticisers (latices), biocides, additives for improving the dye-, coupler- and dye stability, additives for reducing colour fogging and for reducing yellowing, and other substances. Suitable compounds are given in Research Disclosure 37254, Part 8 (1995), page 292, in Research Disclosure 37038, Parts IV, V, VI, VII, X, XI and XIII (1995), pages 84 et seq., and in Research Disclosure 38957, Parts VI, VIII, IX, X (1996), pages 607, 610 et seq.

The layers of colour photographic materials are usually hardened, i.e. the binder used, preferably gelatine, is crosslinked by suitable chemical methods.

Suitable hardener substances are described in Research Disclosure 37254, Part 9 (1995), page 294, in Research Disclosure 37038, Part XII (1995), page 86, and in Research Disclosure 38957, Part II.B (1996), page 599.

After image-by-image exposure, colour photographic materials are processed by different methods corresponding to their character. Details on the procedures used and the chemicals required therefor are published in Research Disclosure 37254, Part 10 (1995), page 294, in Research Disclosure 37038, Parts XVI to XXIII (1995), page 95 et seq., and in Research Disclosure 38957, Parts XVIII, XIX, XX (1996), page 630 et seq., together with examples of materials.

EXAMPLE

Sample 1

The following layers were deposited on a film base comprising paper coated on both sides with polyethylene. The quantitative data are given with respect to 1 $m^2$.

| | |
|---|---|
| Layer 1: | substrate layer comprising 200 mg gelatine |
| Layer 2: | a blue-sensitive silver chloride emulsion (99.5 mol % chloride) comprising 0.51 g $AgNO_3$<br>1.10 g gelatine<br>0.39 g yellow coupler I-21<br>0.17 g yellow coupler I-22<br>0.17 g tricresyl phosphate oil-former<br>0.11 g iso-octadecyl alcohol oil-former<br>0.19 g image stabiliser IV-8 |
| Layer 3: | a protective layer comprising 0.8 g gelatine and 0.04 g hardener H-1 |

H-1

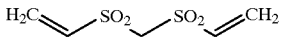

The sample was exposed through a stepped photometric absorption wedge, and colour filters were placed in the beam path so that only the blue-sensitive layer was exposed. The sample was subsequently processed as follows:

| | | |
|---|---|---|
| a) | Colour developer - 45 sec - 35° C. | |
| | tetraethylene glycol | 20.0 g |
| | N,N-diethylhydroxylamine | 2.0 g |
| | N,N-bis-(2-sulphoethyl)hydroxylamine, disodium salt | 2.0 g |
| | N-ethyl-N-(2-methanesulphonamidoethyl)-4-amino-3-methylbenzene sulphate | 5.0 g |
| | potassium sulphite | 0.2 g |
| | potassium carbonate | 30.0 g |
| | hydroxyethanediphosphonic acid | 0.2 g |
| | polymaleic anhydride | 2.5 g |
| | optical brightener (4,4'-diaminostilbenesulphonic acid derivative) | 2.0 g |
| | potassium bromide | 0.02 g |
| | made up with water to 1000 ml; pH adjusted with KOH or $H_2SO_4$ to pH 10.2. | |
| b) | Bleach-fixing - 45 sec - 35° C. | |
| | ammonium thiosulphate | 75.0 g |
| | sodium hydrogen sulphite | 13.5 g |
| | ethylenediaminetetraacetic acid (iron ammonium salt) | 45.0 g |
| | made up with water to 1000 ml; pH adjusted with ammonia (25 % by weight) or acetic acid to pH 6.0. | |
| c) | Washing - 90 sec - 33° C. | |
| d) | Drying | |

The sample was subsequently subjected to the light of a xenon lamp which had been normalised to daylight and was exposed at $15 \cdot 10^6$ lux/hour. The percentage density decrease was determined (Table 1).

Samples 2 to 5

Samples 2 to 5 were produced and tested in the same manner as Sample 1, except that the polymers listed in Table 1 were used.

| | | Image dye stability after $15 \cdot 10^6$ lux/hour (%) | | |
|---|---|---|---|---|
| Sample No. | Polymer (g) | D = 0.6 | D = 1.4 | Dmax |
| 1 (C) | — | −28 | −29 | 2.31 |
| 2 (C) | VP-1 (0.08) | −22 | −24 | 2.22 |
| 3 (I) | II-1 (0.08) | −15 | −18 | 2.44 |
| 4 (I) | II-2 (0.063) | −17 | −16 | 2.36 |
| 5 (I) | II-4 (0.063) | −18 | −16 | 2.31 |

VP-1: poly-t-butylacrylamide; C = comparison, I = invention

As shown in Table 1, the use of compounds of formula (II) according to the invention results in a considerable improvement in the stability to light without the maximum densities being reduced.

What is claimed is:

1. A color photographic material which comprises at least one light-sensitive silver halide emulsion layer, and which, in at least one layer which contains a color coupler, contains at least one homo- or copolymer which comprises a monomer unit of formula (II)

(II)

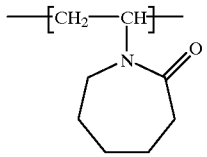

wherein the monomer unit (II) amounts to at least 10% by weight in copolymers, wherein the material contains at least one yellow coupler, at least one magenta coupler and at least one cyan coupler and wherein the material can be processed without intensification.

2. A color photographic material which comprises at least one light-sensitive silver halide emulsion layer, and which, in at least one layer which contains a color coupler, contains at least one homo- or copolymer which comprises a monomer unit of formula (II)

(II)

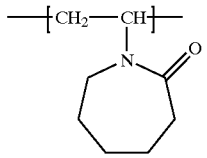

wherein the monomer unit (II) amounts to at least 10% by weight in copolymers, and wherein the color coupler corresponds to formula (I)

(I)

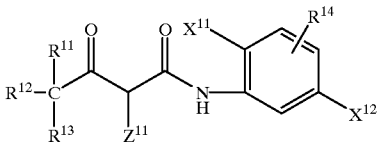

wherein $R^{11}$ and $R^{12}$, independently of each other in each case, are alkyl, or $R^{11}$ and $R^{12}$ can jointly form a ring system, $R^{13}$ is H or has the meaning of $R^{11}$ or $R^{12}$, $R^{14}$ is H, alkyl or halogen, $X^{11}$ is halogen or alkoxy, $X^{12}$ is acyl, acylamino, halogen, sulphonamido or sulphamoyl, $Z^{11}$ is a group of formula

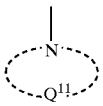

and $Q^{11}$ is an organic group for the completion of a 5- or 6-membered ring.

3. The color photographic material according to claim 2, wherein $R^{11}$ and $R^{12}$ independently are a $C_1$–$C_4$ alkyl, $R^{13}$ is H or a $C_1$–$C_4$ alkyl, $R^{14}$ is H, $X^{11}$ is Cl or alkoxy, $X^{12}$ is alkoxycarbonyl or alkylcarbonylamino, and $Z^{11}$ is an imidazolyl, 1,3,4-triazolyl, oxazoledionyl or hydantoinyl radical.

4. The color photographic material according to claim 2, wherein said monomer is a comonomer which is an ester of acrylic acid, ester of methacrylic acid, vinyl ester, vinyl ether, olefine or methacrylamide.

5. The color photographic material according to claim 2, which further comprises a compound of the formula (III)

(III)

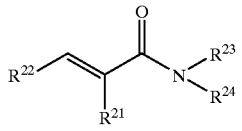

wherein $R^{21}$ is H or alkyl, $R^{22}$ is H, alkyl or aryl, and $R^{23}$ and $R^{24}$, independently of each other in each case, are aryl, a secondary alkyl or a tertiary alkyl.

6. A color photographic material which comprises at least one light-sensitive silver halide emulsion layer, and which, in at least one layer which contains a color coupler, contains at least one homo- or copolymer which comprises a monomer unit of formula (II)

(II)

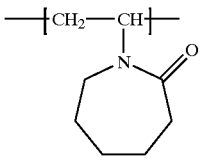

wherein the monomer unit (II) amounts to at least 10% by weight in copolymers, and wherein the coupler corresponds to one of formula Ib or Ic (Ib)

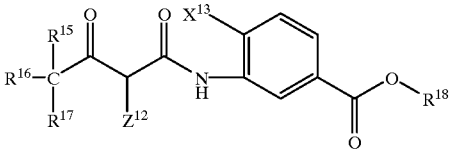

(Ic)

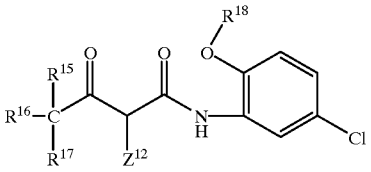

wherein $R^{15}$ and $R^{16}$ are methyl or $R^{15}$ and $R^{16}$ can jointly form a 3- to 6-membered, carbocyclic ring, $R^{17}$ is H or methyl, $Z^{12}$ is an imidazolyl, 1,3,4-triazolyl, oxazoledionyl hydantoinyl radical, $X^{13}$ is chlorine or alkoxy, and $R^{18}$ is alkyl.

7. The color photographic material according to claim 5, wherein the compounds of formula (III) correspond to formula (IIIa)
wherein (IIIa)

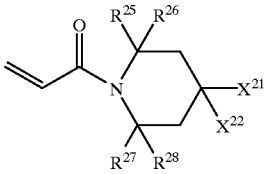

$R^{25}$ and $R^{27}$, independently of each other, are H or alkyl, $R^{26}$ and $R^{28}$, independently of each other, are alkyl, $X^{21}$ is alkoxy, acyl, alkylamino or acyloxy, and $X^{22}$ is H or has the same meaning as $X^{21}$, with the proviso that $X^{21}$ and $X^{22}$ can jointly form a 5- to 6-membered ring, and wherein (IIIa) contains no hydroxyphenol substituents.

8. A color photographic material which comprises at least one light-sensitive silver halide emulsion layer, and which, in at least one layer which contains a color coupler, contains at least one homo- or copolymer which comprises a monomer unit of formula (II)

(II)

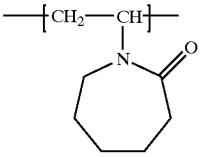

wherein the monomer unit (II) amounts to at least 10% by weight in copolymers, and which further comprises an image stabilizer of formula (IV)

(IV)

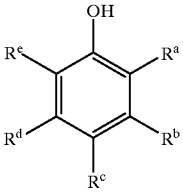

wherein $R^a$, $R^b$, $R^d$, $R^e$ independently are H, alkyl, aryl, aralkyl, acylamino, acyl or halogen and $R^c$ is alkyl, aryl, aralkyl, acyl or acylamino.

9. The color photographic material according to claim 1, wherein the compounds of formula (II) are used in a ratio by weight from 1:20 to 10:1 with respect to the compounds of formula (I).

10. The color photographic material according to claim 5, wherein the compounds of formula (III) are used in a ratio by weight from 1:20 to 2:1 with respect to the compound of formula (I).

11. The color photographic material according to claim 1, wherein the monomer unit (II) amounts to at least 40% by weight in copolymers.

12. The color photographic material according to claim 4, wherein said comonomer is methacrylamide and is in an amount up to 50% by weight.

13. The color photographic material according to claim 3, wherein said monomer is a ester of acrylic acid.

14. The color photographic material according to claim 1, wherein the polymer has a weight average molecular weight between 10,000 and 150,000.

15. The color photographic material according to claim 5, wherein $R^{14}$ is H, $X^{11}$ is chlorine or alkoxy, $X^{12}$ is alkoxycarbonyl or alkylcarbonyl amino, $R^{21}$ is H or methyl, $R^2$ is hydrogen, methyl, phenyl or 4-alkoxyphenyl.

16. The color photographic material according to claim 6, wherein $R^{15}$, $R^{16}$ and $R^{17}$ are $CH_3$.

17. The color photographic material according to claim 6, which further comprises a compound of the formula (IIIa)

(IIIa)

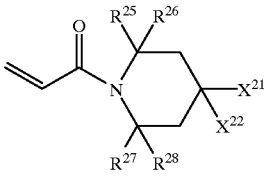

wherein $R^{25}$ and $R^{27}$, independently of each other, are H or alkyl, $R^{26}$ and $R^{28}$, independently of each other, are alkyl, $X^{21}$ is alkoxy, acyl, acylamino, alkylamino or acyloxy, and $X^{22}$ is H or has the same meaning as $X^{21}$ with the proviso that $X^{21}$ and $X^{22}$ can jointly form a 5- to 6-membered ring, and wherein (IIIa) contains no hydroxyphenol substituents.

18. The color photographic material according to claim 17, wherein $R^{15}$, $R^{16}$, $R^{17}$, $R^{25}$, $R^{26}$ and $R^{27}$, and $R^{28}$ are $CH_3$.

19. The color photographic material according to claim 1, wherein the compounds of the formula (II) are a) polyvinylcaprolactam, b) a copolymer of vinylcaprolactam and ethyl acrylate, c) a copolymer of vinylcaprolactam, t-butylacrylamide and hydroxyethyl acrylate, d) a copolymer of vinylcaprolactam and t-butylacrylamide or e) a copolymer of vinylcaprolactam and

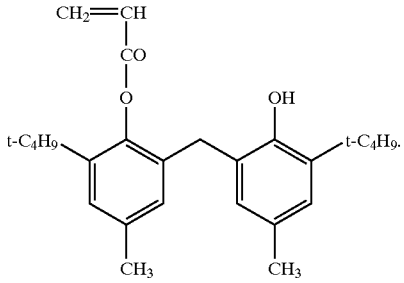

* * * * *

UNITED STATES PATENT AND TRADEMARK OFFICE

CERTIFICATE OF CORRECTION

PATENT NO. : 6,548,238 B2
DATED : April 15, 2003
INVENTOR(S) : Beate Weber et al.

It is certified that error appears in the above-identified patent and that said Letters Patent is hereby corrected as shown below:

Column 21,
Line 66, after "oxazoledionyl" insert -- or --.

Signed and Sealed this

Twenty-sixth Day of August, 2003

JAMES E. ROGAN
*Director of the United States Patent and Trademark Office*